US011150571B2

(12) United States Patent
Butler et al.

(10) Patent No.: US 11,150,571 B2
(45) Date of Patent: Oct. 19, 2021

(54) Y-SHAPED BRUSHES

(71) Applicant: HP INDIGO B.V., Amstelveen (NL)

(72) Inventors: Blair A. Butler, San Diego, CA (US); Scott Sayer, Corvallis, OR (US); Ziv Yosef, Ness Ziona (IL); David Sabo, San Diego, CA (US)

(73) Assignee: HP Indigo B.V., Amstelveen (NL)

( * ) Notice: Subject to any disclaimer, the term of this patent is extended or adjusted under 35 U.S.C. 154(b) by 38 days.

(21) Appl. No.: 16/603,799

(22) PCT Filed: Apr. 18, 2017

(86) PCT No.: PCT/US2017/028086
§ 371 (c)(1),
(2) Date: Oct. 8, 2019

(87) PCT Pub. No.: WO2018/194559
PCT Pub. Date: Oct. 25, 2018

(65) Prior Publication Data

US 2021/0088926 A1 Mar. 25, 2021

(51) Int. Cl.
*G03G 15/02* (2006.01)

(52) U.S. Cl.
CPC ..... *G03G 15/0233* (2013.01)

(58) Field of Classification Search
CPC ..... G03G 15/02; G03G 15/0233; G03G 15/0805; G03G 15/0907; G03G 2215/021
USPC ..... 399/115, 168, 174, 175
See application file for complete search history.

(56) References Cited

U.S. PATENT DOCUMENTS

| | | | |
|---|---|---|---|
| 4,761,709 A | 8/1988 | Ewing | |
| 4,894,686 A | 1/1990 | Bujese | |
| 5,245,386 A | 9/1993 | Asano | |
| 5,398,102 A | 3/1995 | Wada | |
| 8,275,292 B2 | 9/2012 | Tomari et al. | |
| 8,374,531 B2 | 2/2013 | Nakagawa et al. | |
| 8,406,649 B2 | 3/2013 | Cavill et al. | |
| 8,676,092 B2 | 3/2014 | Okabe et al. | |
| 8,737,883 B2 | 5/2014 | Iwasaki | |
| 9,176,415 B2 * | 11/2015 | Kobayashi | G03G 15/0225 |

FOREIGN PATENT DOCUMENTS

| | | |
|---|---|---|
| JP | H06282172 A | 10/1994 |
| JP | 2008151870 A | 7/2008 |

* cited by examiner

*Primary Examiner* — Hoan H Tran
(74) *Attorney, Agent, or Firm* — Fabian VanCott

(57) ABSTRACT

A roller charging device may include a Y-shaped electrically conductive brush and a screw terminal coupling the Y-shaped electrically conductive brush to a housing of the roller charging device and electrically coupling the Y-shaped electrically conductive brush to a power source. A printing fluid developer may include a plurality of rollers and a plurality of Y-shaped brushes to each contact one of the plurality of rollers wherein each of the Y-shaped brushes provides an electrical charge to each of the plurality of rollers.

20 Claims, 7 Drawing Sheets

Y-SHAPED BRUSHES

BACKGROUND

Image forming devices include fax machines, copiers, and printing devices, among other devices. These image-forming devices often use a number of rollers to apply an image to a sheet of media or a web substrate.

BRIEF DESCRIPTION OF THE DRAWINGS

The accompanying drawings illustrate various examples of the principles described herein and are part of the specification. The illustrated examples are given merely for illustration, and do not limit the scope of the claims.

Figure 1:
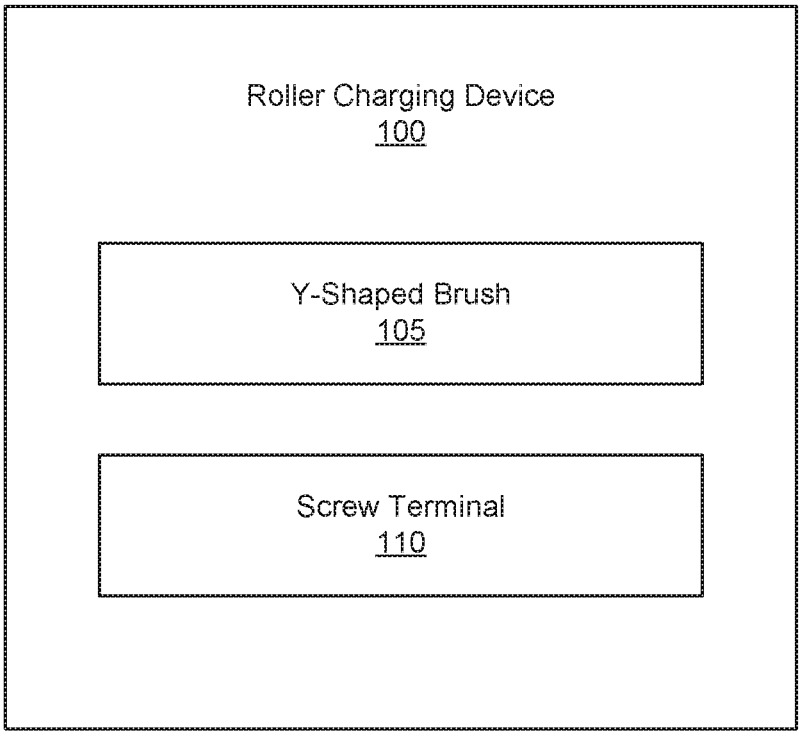
FIG. 1 is a block diagram of a roller charging device according to an example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

As described above, image forming devices implement a number of rollers to apply an image to the surface of a sheet of media or a web substrate. Among these rollers is a photoconductive roller having a photoconductive surface that is charged to a uniform electrical potential. The photoconductive surface is selectively exposed to a light source corresponding to an image to be formed on the surface of the print media. This results in certain areas of the photoconductive surface being electrically discharged which, in turn, results in the formation of an electrostatic image thereon.

In order to form the image, the photoconductive surface attracts an oppositely electrically charged developer material to those portions of the photoconductive surface that were not exposed to the light source. Additional rollers such as a developer roller may be used to transport the developer material to the photoconductive surface of the photoinductive roller. More or less rollers may also be employed to remove any excess developer material from any surface of the photoconductive roller and/or developer roller. In order to accomplish this, each of these individual rollers may be electrically charged to accomplish the removal or attraction of the developer material. In some examples, each of these rollers may be maintained at a predefined electrical potential using a carbon brush.

The brush may be a solid piece of carbon that is forced against an outer surface of a roller in order to couple the roller to a voltage source. As the roller turns, the brush may be pressed against the surface thereby applying a predetermined charge to the roller. However, the carbon brush may degrade over time as the material of the brush is rubbed away. Eventually, the material is depleted and the electrical connection to the roller is lost resulting in the inability of the brush to charge the roller.

Additionally, the housing used in connection with the carbon brush may increase the space used within the image forming device. The carbon brush is forced against the roller through a housing using a spring. The housing is maintained in place by a clip which also serves as an electrical connection to the carbon brush via an electrical line. Additionally, the carbon brush has a spring that forces the carbon brush against the roller. The clip may then be in electrical connection with a voltage source via an electrical manifold. Each of these elements may further be housed in a larger housing meant to maintain a number of carbon brushes against the outer surface of individual rollers. Thus, in addition to these elements increasing the space used within the image forming device, the assembly of these elements and the parts themselves increases the cost of manufacturing the image forming device.

The present specification describes a roller charging device that includes a Y-shaped electrically conductive brush and a screw terminal coupling the Y-shaped electrically conductive brush to a housing of the roller charging device and electrically coupling the Y-shaped electrically conductive brush to a power source.

The present specification also describes a printing fluid developer that includes a plurality of rollers and a plurality of Y-shaped brushes to each contact one of the plurality of rollers wherein each of the Y-shaped brushes provides an electrical charge to each of the plurality of rollers.

The present specification further describes a Y-shaped charging brush includes a bulb formed on each arm of the Y-shaped brush and a coupling hole to receive a conductive coupler that electrically couples the Y-shaped brush to a power source.

As used in the present specification and in the appended claims, the term "brush" is meant to be understood as a device that contacts a roller to impart an electrical charge thereto.

Additionally, as used in the present specification and in the appended claims, the term "a number of" or similar language is meant to be understood broadly as any positive number comprising 1 to infinity; zero not being a number, but the absence of a number.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described in connection with that example is included as described, but may or may not be included in other examples.

Turning now to the figures, FIG. 1 is a block diagram of a roller charging device (100) according to an example of the principles described herein. The roller charging device (100) includes a Y-shaped brush (105) and a screw terminal (110).

The roller charging device (100) may be placed in contact with a portion of a number of rollers. As described above, the roller charging device (100) acts as a conduit through which the roller receives a voltage. In an example, the roller charging device (100) contacts an outer surface of a roller in order to apply the voltage to the roller. In an example, the roller charging device (100) contacts an axel of the roller that is in electrical communication with the outer surface of the roller. In this example, the roller charging device (100) may contact the outer surface of the axel.

The Y-shaped brush (105) may include two arms and a single leg generally in the shape of the letter "Y." The shape of the Y-shaped brush (105) allows an outer surface of a roller to fit in between the arms of the Y-shaped brush (105). In an example, the arms of the Y-shaped brush (105) continuously contact an outer surface of a roller. This may be accomplished, in an example, by forming the arms of the Y-shaped brush (105) to have a maximum distance from the tips of the arms less than the diameter of an outer surface of the roller the arms are to make contact with. In this example, the arms of the Y-shaped brush (105) may be spring biased against the outer surface of the roller when the roller is cradled in between the arms of the Y-shaped brush (105), In an example, the arms of the Y-shaped brush (105) may bend a distance of between 80 and 120 μm. In an example, the arms of the Y-shaped brush (105) may bend a distance of 100 μm.

In an example, the Y-shaped brush (105) along with its arms are made of a resin made of a polycarbonate. In an example, the resin of polycarbonate may include between 30 and 50% carbon fiber filler. In an example, the resin of polycarbonate may include 40% carbon fiber filler. In an example, the resin of polycarbonate may include between 5 and 15% PTFE. In an example, the resin of polycarbonate may include 10% PTFE, In an example, the Y-shaped brush (105) and its arms are made of a resin of polycarbonate including 40% carbon and 10% PTFE. In an example, the Y-shaped brush (105) may further include an amount of silicone as a lubricant. These examples, are not meant to be limiting and the present specification contemplates the use of any type of material that will, at least, allow the arms of the Y-shaped brush (105) to resistively bend against a surface of a brush. Additional lubricants, conductive material, and lubricants may also be contemplated in the present specification.

As described herein, the Y-shaped brush (105) is electrically conductive such that it may pass an electrical charge from a voltage source to the roller. To complete the conductive path from the voltage source and to also couple the Y-shaped brush (105) to a housing where the roller resides, the Y-shaped brush (105) may further include a screw terminal (110). The screw terminal (110) may be a hole defined in the Y-shaped brush (105) in order to receive a screw or other type of fastener therein, Although the present specification may describe the screw terminal (110) as receiving a screw, the present specification contemplates the use of any type of coupling device.

The screw terminal (110), in an example, is a hole defined in the Y-shaped brush (105) to receive a screw as well as serve as a point where an electrical lead can be coupled to the Y-shaped brush (105). In an example, the coupling of the Y-shaped brush (105) to a housing of the rollers by the screw terminal (110) allows the electrical lead to be coupled to the screw to complete the electrical connection. In this way, the amount of space occupied by the roller charging device (100) is reduced relative to the carbon brushes and housings described herein. Additionally, fewer parts are used in the construction of the roller charging device (100) thereby decreasing costs in manufacturing with regard to both manufacturing of parts as well as assembly of those parts.

The two arms of the Y-shaped brush (105) are situated such that the two arms may contact an outer surface of the roller. This provides for two individual points of contact between the roller charging device (100) and the roller. In certain examples, the roller may move away or towards the roller charging device (100) during operation of the image forming device. This may be allowed to occur so that the roller, when engaging with other mechanisms or rollers in the image forming device, may move slightly in order to accommodate for movement of those elements. In an example, when two rollers interact, differences in the diameters of each roller may cause any of the rollers to move slightly so as to maintain a certain pressure against each other. Thus, during operation, the movement of the roller may cause other types of brushes of lose contact with the roller thereby not charging the roller. In the case of the roller charging device (100) with its Y-shaped brush (105), however, movement of the roller may cause one of the two arms of the Y-shaped brush (105) to lose contact with the roller, but the other arm will remain in contact with the roller thereby maintaining the charge to the roller. Consequently, the transfer of any developer material to any roller charged by the roller charging device (100) will not be interrupted by the Y-shaped brush (105) losing contact with the roller.

In an example, each of the arms of the Y-shaped brush (105) of the roller charging device (100) may include a bump defined thereon. The bumps provide a surface on the Y-shaped brush (105) that the roller may contact.

Figure 2:
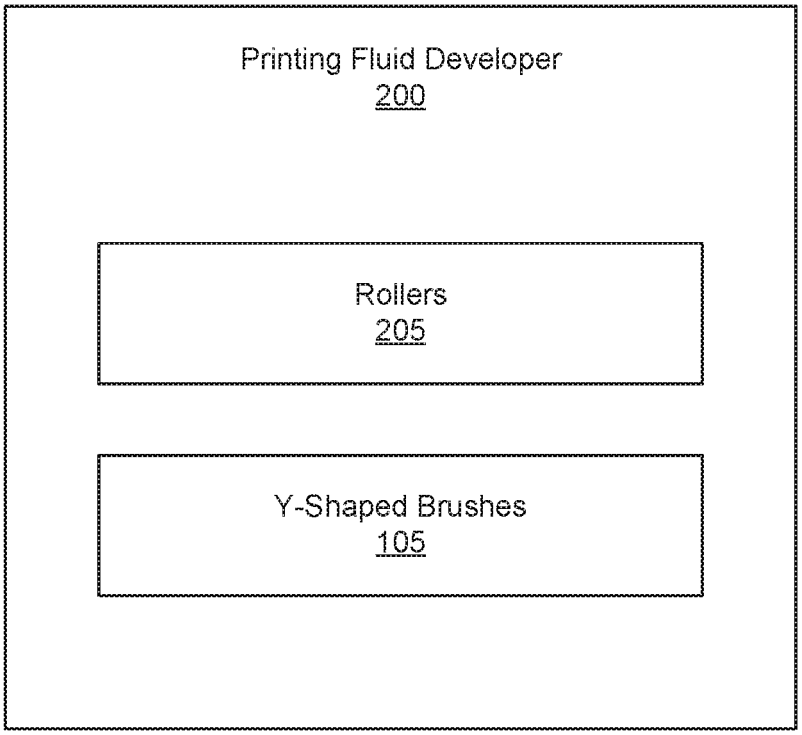
FIG. 2 is a block diagram of a printing fluid developer according to an example of the principles described herein.

FIG. 2 is a block diagram of a printing fluid developer (200) according to an example of the principles described herein. The printing fluid developer (200) may include a number of rollers (205) and a number of Y-shaped brushes (105).

The printing fluid developer (200), in an example, may be any device that applies an amount of printing fluid to a surface of a photoconductive member. The "printing fluid" in the "printing fluid developer" may be any type of printing fluid and is not necessarily limited in the present specification to any specific type of printing fluid. Although a printing fluid developer (200) is described here in connection with FIG. 2, the present specification contemplates the use of the Y-shaped brushes (105) in connection with any number of rollers (205) in any device used to apply a printing fluid to a sheet of media. Thus, the present specification contemplates these alternative examples and for ease of understanding a printing fluid developer (200) will be described as an example of in what device or situation a Y-shaped brush (105) may be used.

In the example described in connection with FIG. 2, a plurality of printing fluid developer (200) may be used in an image forming device such that different colors of printing fluid may be used to apply an image to the surface of a print media. Accordingly, each of the plurality of printing fluid developers (200) may each include a number of Y-shaped brushes (105) and a number of number of rollers (205). The number of rollers (205) may each be associated with a respective Y-shaped brush (105) such that each of the number of rollers (205) may be electrically charged as described herein.

The Y-shaped brushes (105) may be similar to the Y-shaped brushes (FIG. 1, 105) as described in connection with FIG. 1. In some examples, the Y-shaped brushes (105) are coupled to a housing of the printing fluid developer (200) using a conductive screw that allows for a voltage to flow through the screw and into each of the Y-shaped brushes (105) individually. Thus, the conductive screws both hold the number of Y-shaped brushes (105) to the housing as well as provide an electrically conductive path from a voltage source to the conductive Y-shaped brushes (105) which, in turn, are electrically coupled to a surface of each of the number of rollers (205).

In an example, the electrical lead coupled to the conductive screw may connect the conductive screw to a voltage source via a D-subminiature connector. In this example, the D-subminiature connector may control the voltage to each of the Y-shaped brushes (105) by applying the various voltages to each of the leads. In this example, each of the number of rollers (205) may be set to a different and specific voltage potential such that the developer material may be attracted to and from each of the number of rollers (205) during operation of the printing fluid developer (200). The D-subminiature connector may also provide a physical interface between the electrical leads/conductive screw/Y-shaped brushes (105) assemblies and a voltage source.

The Y-shaped brushes (105) may include any one of those features of the Y-shaped brushes (105) as described in connection with FIG. 1, In an example, the Y-shaped brushes (105) may each include bulbs formed on each of the ends of the arms of each Y-shaped brush (105). This allows, in some examples, redundant points of contact between the Y-shaped brushes (105) and an outer surface of each of the number of rollers (205). In circumstances where any of the number of rollers (205) move away from any of the arms of the Y-shaped brushes (105), the alternative arm may still remain in contact. In an example, the orientation of the Y-shaped brushes (105) may be configured such that at any given moment during operation of the printing fluid developer (200), at least one arm of each of the Y-shaped brushes (105) may remain in contact with each of the number of rollers (205) so as to keep the rollers (205) charged appropriately.

Figure 3:
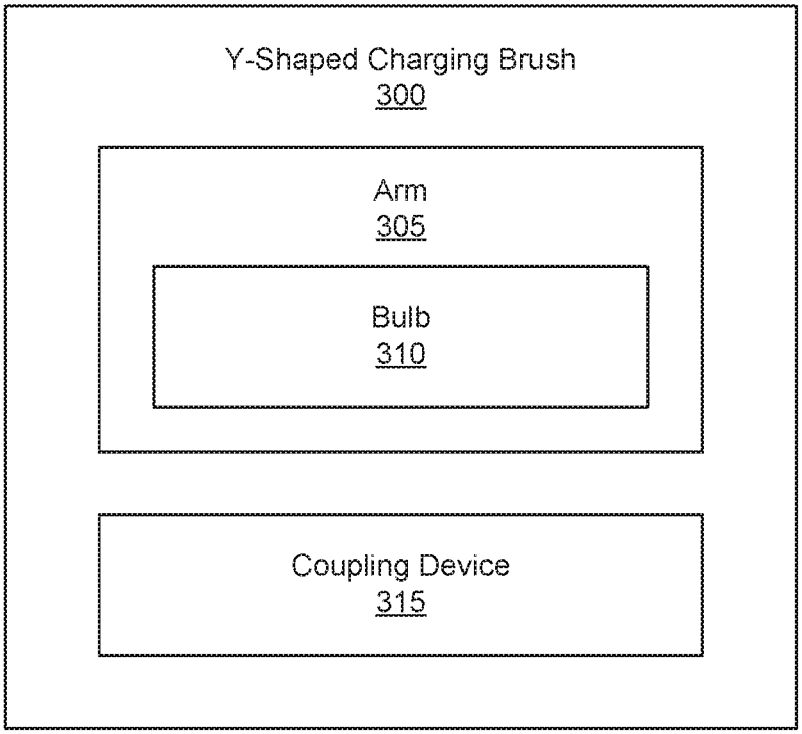
FIG. 3 is a block diagram of a Y-shaped charging brush according to an example of the principles described herein.
Figure 4A:
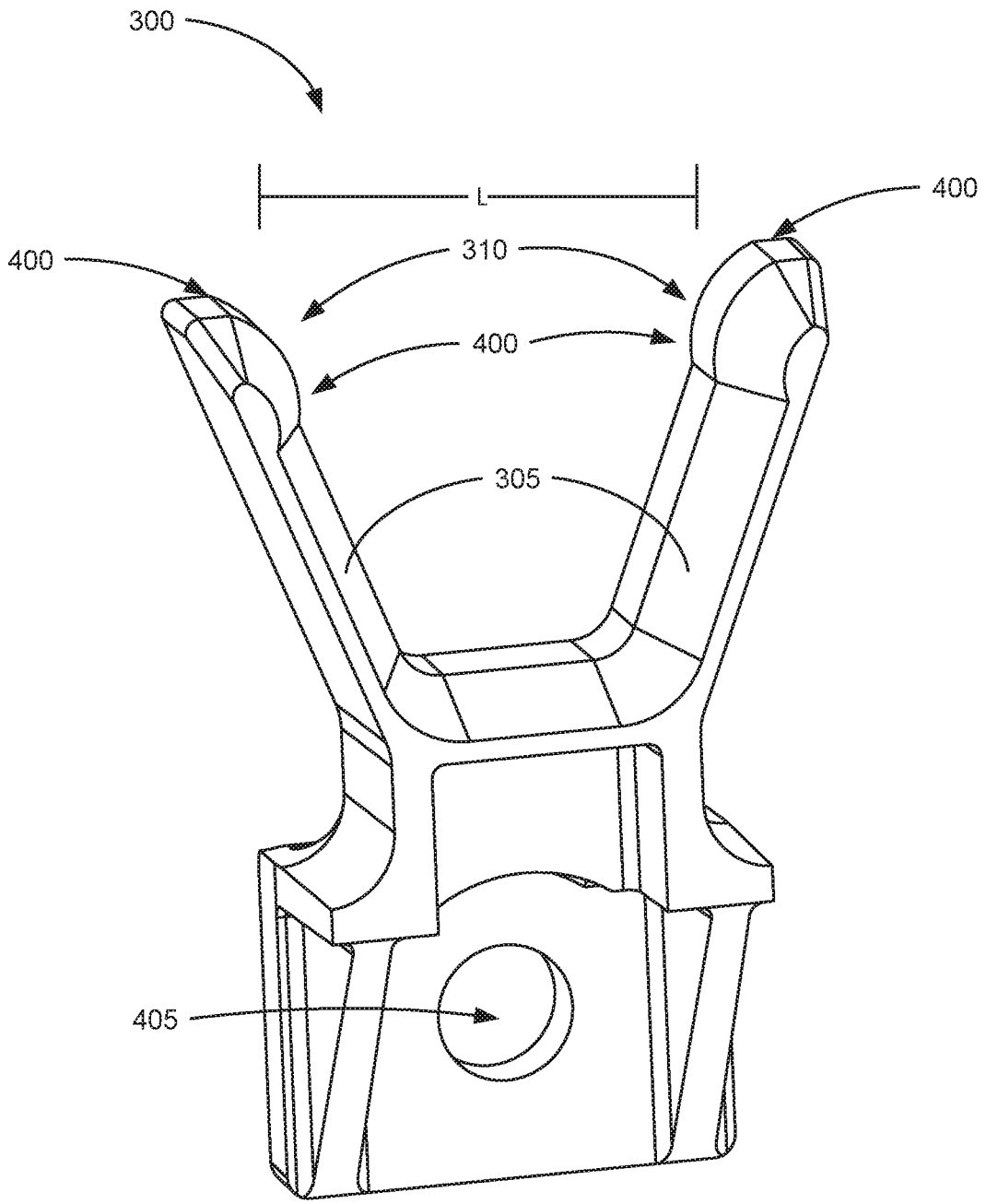
FIGS. 4A through 4C show a front perspective view, a side view, and a rear plan view, respectively, of a Y-shaped brush according to an example of the principles described herein.
Figure 4B:
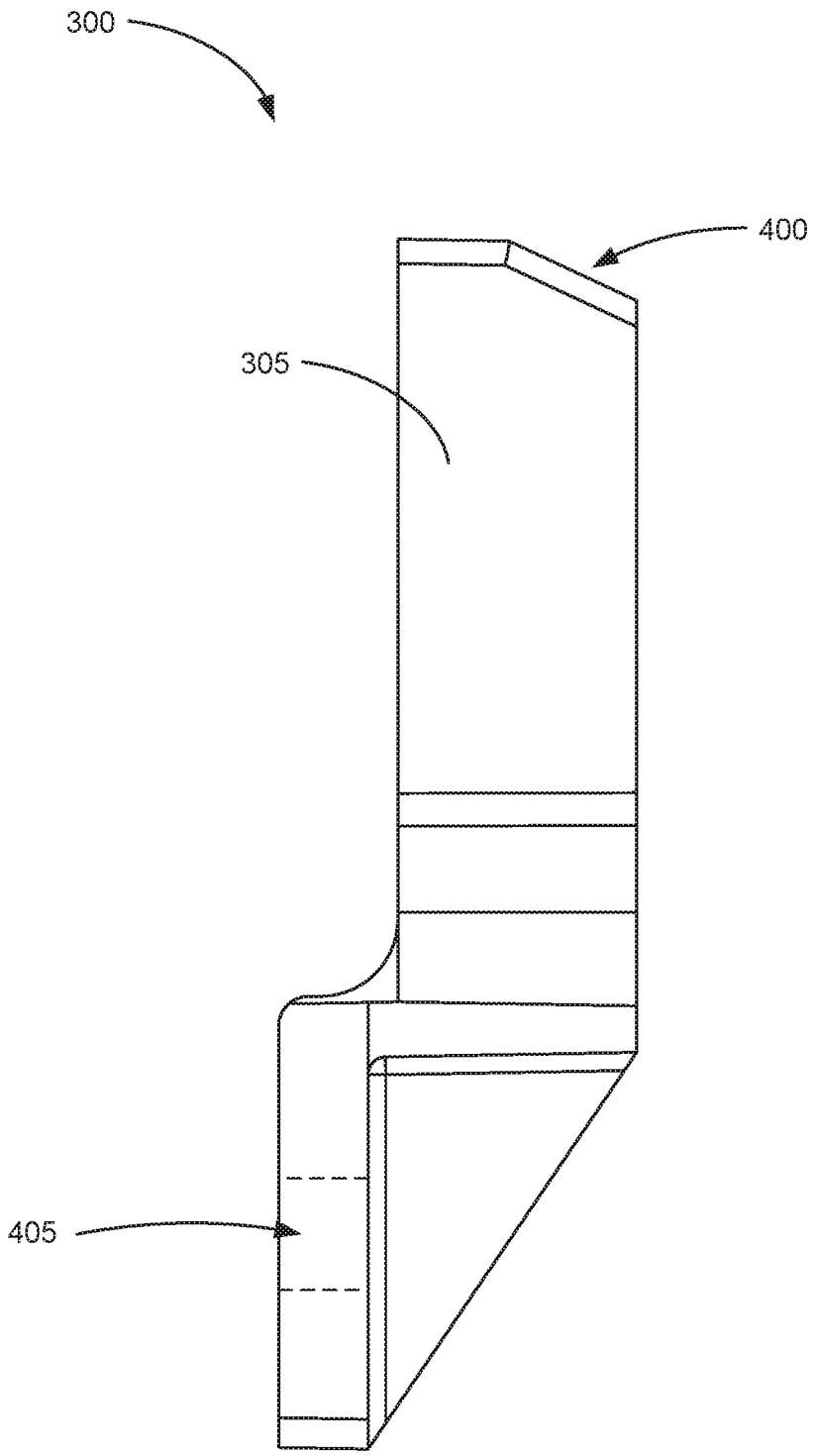
Figure 4C:
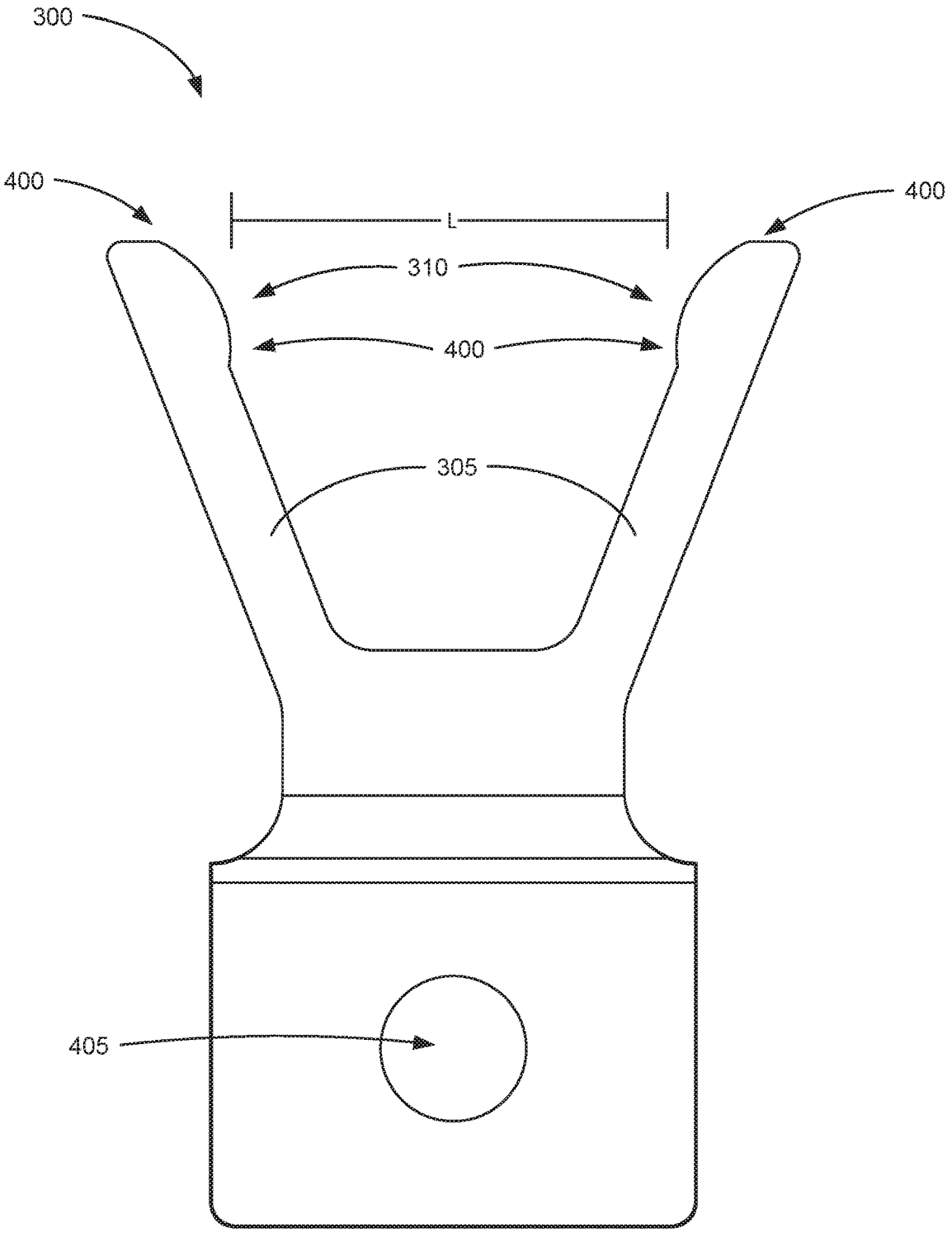

FIG. 3 is a block diagram of a Y-shaped charging brush (300) according to an example of the principles described herein. The Y-shaped charging brush (300) may include two arms (305) with each arm including a bulb (310). The Y-shaped brushes (105) may further include a coupling device (315).

The bulbs (310) on the arms (305) of the Y-shaped charging brush (300) may come in immediate contact with the outer surface of a roller. In an example, the bulbs (310) may provide a thicker location where the Y-shaped charging brush (300) may interface with the roller. If portions of the Y-shaped charging brush (300) are to wear down, the thicker portions of the Y-shaped charging brush (300) that make up the bulbs (310) provide for a location where the wear may occur. As a roller is placed between the arms (305) of the Y-shaped charging brush (300), the bulbs (310) contact the outer surface of the roller or an axel of the roller. In an example, the arms (305) of the Y-shaped charging brush (300) may bend slightly as the roller is placed in between the arms (305). As described herein, the arms (305) may flex a distance to accommodate a relatively larger diameter roller. The arms (305) may be biased towards the surface of the roller or axel of the roller such that removal of the roller will allow the arms (305) to return to their manufactured state.

The Y-shaped charging brush (300) may further include a coupling device (315) that receives a conductive coupler that electrically couples the Y-shaped brush to a power source. The coupling device (315) may be any type of coupling device that can couple the Y-shaped charging brush (300) to a housing of a roller, couple a power source lead to the Y-shaped charging brush (300), or both. In an example, the coupling device includes a hole defined in the surface of the Y-shaped charging brush (300) to receive a screw. The screw may electrically couple a lead to the Y-shaped charging brush (300) thereby allowing the Y-shaped charging brush (300) to charge the roller as described herein.

In an example, the bulbs (310) may include a number of tapered faces leading to the bulbs (310) creating a sloped surface to the bulbs (310). As the roller is placed in between the arms (305) of the Y-shaped charging brush (300), the tapered faces may slide the bulbs (310) to an interfacing location against the surface of the roller or surface of the axel of the roller.

FIGS. 4A through 40 show a front perspective view, a side view, and a rear plan view, respectively, of a Y-shaped brush (300) according to an example of the principles described herein. As described in connection with FIGS. 1-3, the Y-shaped brush (300) may include two arms (305). A roller or the axel of a roller may be placed between the two arms (305) of the Y-shaped charging brush (300). In an example, a longest distance "L" between the arms (305) of the Y-shaped charging brush (300) may be a shorter distance than the diameter of a roller or axel of a roller. Thus, when the roller or axel of the roller is placed in between the arms (305), the roller may cause the distance "L" between the arms (305) to increase and bend the arms (305) slightly outwards. The arms (305), however, are biased back in and therefore remain in contact with a surface of the roller.

The arms further include a number of tapered faces (400) on either side of a bulb (310) formed on the arms (305). The tapered faces (400) allows the roller to slide over the surface of the bulb (310) allowing the roller to move relative to the Y-shaped charging brush (300). During operation of the roller, the roller may be allowed to move as a result of the interaction of the roller with, for example, other rollers. Additionally, even as the roller may move away from one of the arms (305), the other of the arms (305) may remain in contact with an outer surface of the roller thereby maintain the charge on the roller.

The Y-shaped brush (300) may further include a hole (405) defined therein. A coupling device such as a screw may be passed through the hole to secure the Y-shaped brush (300) to a housing interfacing the roller. Additionally, an electrical lead may be coupled to the screw as the screw is driven through the hole (405) so that an electrical current may be passed through the lead and the screw and to the Y-shaped brush (300) in order to charge the roller.

Figure 5:
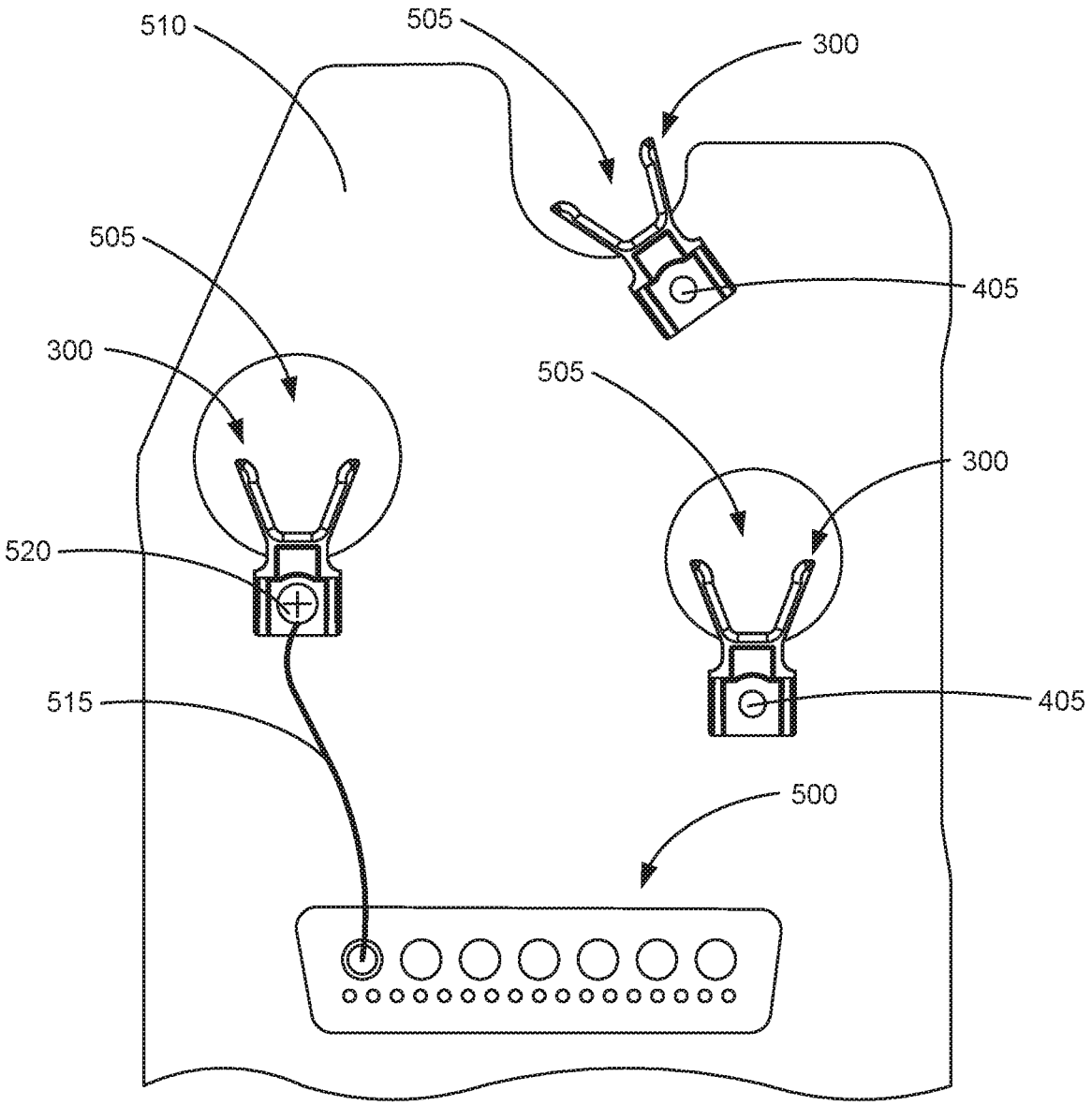
FIG. 5 is a front plan view of a number of Y-shaped brushes coupled to a housing according to an example of the principles described herein.

FIG. 5 is a front plan view of a number of Y-shaped brushes (300) coupled to a housing (510) according to an example of the principles described herein. As described herein, the Y-shaped brushes (300) may be coupled to a housing for a number of rollers. The housing may include a number of roller interfaces (505) through or into which a roller or axel of a roller may be placed in order to interface with the Y-shaped brushes (300).

The housing (510) may further include a D-subminiature connector (500). The D-subminiature connector (500) may serve as the interface through which a voltage source may provide a voltage to the Y-shaped brushes (300). This is accomplished by placing a lead (515) between the D-subminiature connector (500) and an electrically conductive coupling device (520) such as a screw. The D-subminiature connector (500) may receive individual voltages for each of the Y-shaped brushes (300) and therefore may include a lead (515) to each of the individual Y-shaped brushes (300). Although FIG. 5 shows a single lead (515) connecting the D-subminiature connector (500) to a single Y-shaped brush (300), this is for ease of explanation. Instead, the present specification contemplates that each of the Y-shaped brushes (300) will be electrically coupled to the D-subminiature connector (500) and, accordingly, coupled to a voltage source. In an example, a processor communicatively coupled to the voltage source and the D-subminiature connector (500) may direct the application of a charge through the D-subminiature connector (500) and to the Y-shaped brushes (300).

The housing (510) forms part of, for example, a printing fluid developer (200) as described in connection with FIG. 2. During operation of the printing fluid developer (200), a voltage may be applied to each of the rollers such that a printing fluid may be passed from one roller to another and eventually onto a photoconductive member. Any number of printing fluid developers (200) may be implemented to place any type or color of printing fluid onto the surface of the photoconductive member. An image may be formed on the photoconductive member and transferred to a sheet of print media.

The specification and figures describe a Y-shaped brush. The Y-shaped brush may provide for at least two contact points to contact a roller of a printing fluid developer. Where a roller may move away from the Y-shaped brush, at least one of the two arms of the Y-shaped brush may remain in contact with the roller impart the electrical charge. This prevents discharge of the roller and allows the roller to pass or otherwise attract a printing fluid from one roller to another. Still further, the hole defined in the Y-shaped brush allows for a coupler to both couple the Y-shaped brush to a housing of the roller as well as couple an electrical lead to the Y-shaped brush. This eliminates additional housing apparatuses for each brush thereby reducing the amount of space used within a printing fluid developer. Still further, the hole and screw does not implement a soldering point thereby reducing costs of manufacturing and costs of additional housings used to house the brushes. Even further, a spring capability is integrated into the design of the Y-shaped brush so that additional components such as a dedicated spring will not be used. Instead, the arms of the Y-shaped brush may be flexed when in contact with the roller such that are biased against the surface of the roller or the roller's axel.

The preceding description has been presented to illustrate and describe examples of the principles described. This description is not intended to be exhaustive or to limit these principles to any precise form disclosed. Many modifications and variations are possible in light of the above teaching.

What is claimed is:

1. A roller charging device, comprising:

a Y-shaped electrically conductive brush; and a screw terminal coupling the Y-shaped electrically conductive brush to a housing of the roller charging device and electrically coupling the Y-shaped electrically conductive brush to a power source.

2. The roller charging device of claim 1, wherein the Y-shaped electrically conductive brush engages a roller at two separate locations.

3. The roller charging device of claim 1, wherein the Y-shaped electrically conductive brush is infused with a conductive material.

4. The roller charger of device of claim 3, wherein the Y-shaped electrically conductive brush is lubricated with polytetrafluoroethylene (PTFE) and silicone.

5. The roller charging device of claim 1, wherein a number of arms of the Y-shaped electrically conductive brush comprise a number of bumps.

6. The roller charging device of claim 1, wherein the Y-shaped electrically conductive brush fits a roller between two prongs of the Y-shaped electrically conductive brush and wherein the two prongs of the Y-shaped electrically conductive brush are spring biased towards an outer surface of the roller.

7. The roller charging device of claim 1, wherein the Y-shaped electrically conductive brush further comprises a number of tapered faces on each of the two prongs of the Y-shaped electrically conductive brush.

8. The roller charging device of claim 7, wherein the number of tapered faces further include a bulb face extending from the each of the two prongs of the Y-shaped electrically conductive brush to contact a surface of a roller.

9. A printing fluid developer, comprising:

a plurality of rollers; and a plurality of Y-shaped brushes to each contact one of the plurality of rollers;

wherein each of the Y-shaped brushes provides an electrical charge to each of the plurality of rollers;

wherein the plurality of Y-shaped brushes comprise a bulb formed on each arm of the plurality of Y-shaped brushes arranged to contact a surface of one of the plurality of rollers.

10. The printing fluid developer of claim 9, further comprising a conductive screw to physically connect each of the Y-shaped brushes to a housing on the printing fluid developer.

11. The printing fluid developer of claim 10, wherein the conductive screws electrically couple the plurality of brushes to a power source via a D-subminiature connector.

12. A Y-shaped charging brush, comprising:

a surface formed on each arm of the Y-shaped brush to electrically contact and charge a roller; and a coupling device to receive a conductive coupler that electrically couples the Y-shaped brush to a power source;

wherein the arms of the Y-shaped brush are flexible to receive a roller therebetween.

13. The Y-shaped charging brush of claim 12, wherein the flexible arms of the Y-shaped brush are biased toward a surface of a roller disposed therebetween.

14. The Y-shaped charging brush of claim 12, wherein the Y-shaped charging brush is lubricated with polytetrafluoroethylene (PTFE) or silicone.

15. The Y-shaped charging brush of claim 12, further comprising a bulb extending from the surface on each of the arms of the Y-shaped charging brush to contact a surface of a roller disposed therebetween.

16. The Y-shaped charging brush of claim 15, wherein each arm of the Y-shaped brush further comprises a tapered face leading to the bulb.

17. The Y-shaped charging brush of claim 12, wherein the charging brush is made of a resin of polycarbonate.

18. The Y-shaped charging brush of claim 12, further comprising a screw terminal to receive a screw coupling an electrical lead to the brush.

19. The Y-shaped charging brush of claim 12, wherein the surface formed on each arm of the Y-shaped brush comprises a bump defined thereon.

20. The Y-shaped charging brush of claim 12, further comprising a D-subminiature connector electrically connected to the Y-shaped brush.

* * * * *